US006276311B1

(12) United States Patent
Reineking et al.

(10) Patent No.: US 6,276,311 B1
(45) Date of Patent: Aug. 21, 2001

(54) COOLANT OVERFLOW BOTTLE

(75) Inventors: Jerry R. Reineking, Cleveland; Anthony L. Coffey, Grafton, both of WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 09/502,105

(22) Filed: Feb. 10, 2000

(51) Int. Cl.[7] ..... F01P 9/00
(52) U.S. Cl. ..... 123/41.01; 123/41.65
(58) Field of Search ..... 123/41.65, 41.01

(56) References Cited

U.S. PATENT DOCUMENTS 3,757,984 9/1973 Barton ..... 220/27
4,787,445 * 11/1988 Howcroft ..... 165/104.32
5,000,333 3/1991 Petrelli ..... 220/890
5,456,218 10/1995 Theorell ..... 123/41.5
5,722,559 3/1998 Branham ..... 220/562
6,145,479 * 11/2000 Rotter ..... 123/41.49

* cited by examiner

*Primary Examiner*—Tony M. Argenbright
*Assistant Examiner*—Katrina B. Harris
(74) *Attorney, Agent, or Firm*—Quarles & Brady LLP

(57) ABSTRACT

A coolant overflow bottle is interposed between the centrifugal fan and the radiator for guiding air expelled by the fan toward the radiator. The bottle includes a top, a bottom, a pair of nested curved sidewalls, and a rear wall. The side walls are joined at a leading edge, and join the top and bottom. The rear wall is joined to the side walls at a trailing edge, and joins the top and bottom. The bottle wails define an exterior shape for guiding air.

18 Claims, 3 Drawing Sheets

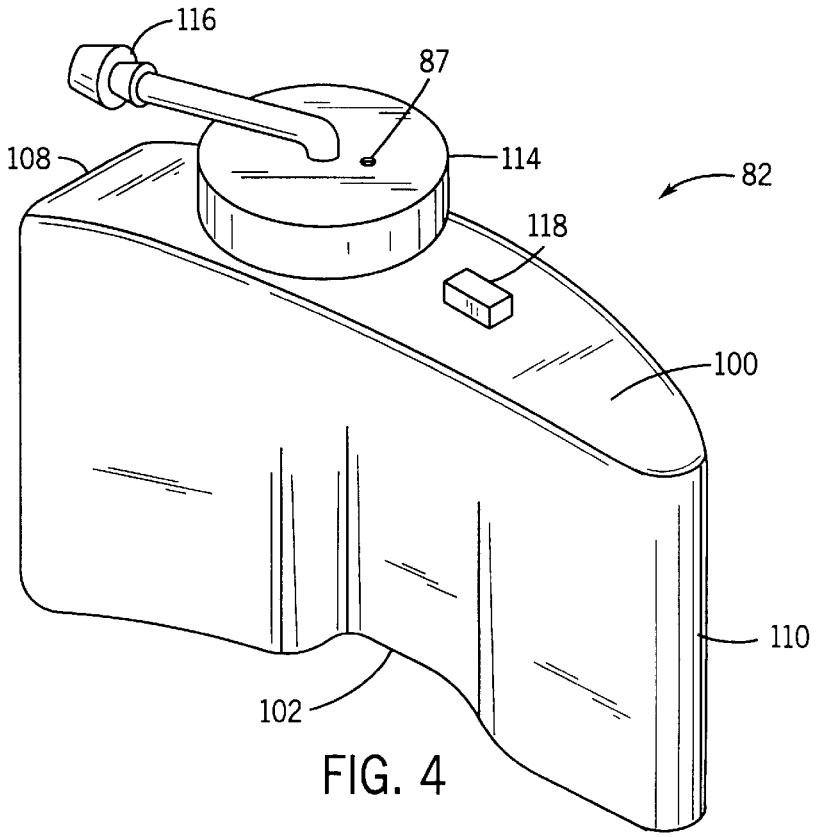
FIG. 4
FIG. 5
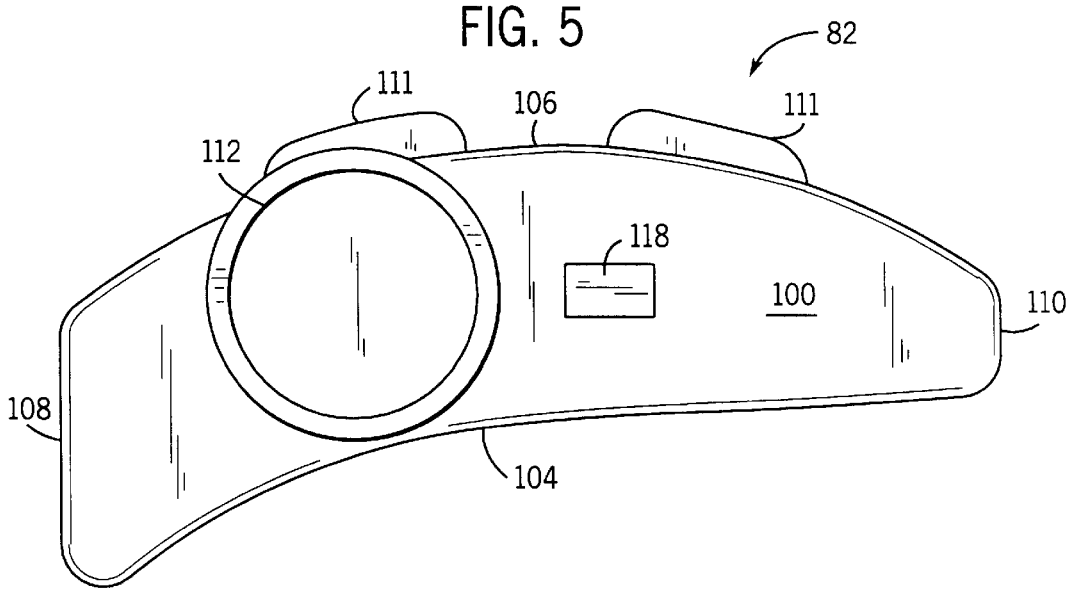

COOLANT OVERFLOW BOTTLE

FIELD OF THE INVENTION

The field of the invention relates to engine cooling, more particularly to the cooling of liquid cooled internal combustion engines.

DESCRIPTION OF THE BACKGROUND ART

Vertical shaft internal combustion engines are becoming increasingly popular for use in lawn tractors. Their vertical shaft drives grass cutting blades without the use of a costly transmission. Consumer preferences, however, currently dictate lawn tractors with a low hood line. In a vertical shaft engine, this requires a short compact configuration. Even in larger tractors, such as those requiring an engine having 16 hp–35 hp, a low hood line is important to consumers. These larger engines, generate a significant amount of heat during operation and are typically liquid cooled. Liquid cooled vertical shaft engine are not easily shortened because of the necessity of a radiator to cool the liquid cooling the engine.

Liquid cooled engines have cooling circuits which circulates liquid coolant to maintain a desired engine temperature. These cooling circuits have coolant bottles for receiving heated coolant which expands beyond the volume capacity of the cooling circuit. When the coolant in the cooling circuit cools, it contracts, drawing coolant from the bottle back into the cooling circuit. The coolant bottles, are generally located proximate the radiator, and attached to an external portion of the engine increasing the overall external engine dimension.

SUMMARY OF THE INVENTION

The present invention provides a coolant overflow bottle having an interior volume for receiving coolant for use with a liquid cooled internal combustion engine.

The bottle includes a top, a bottom, and a pair of nested curved sidewalls joined at a leading edge, and joining the top and bottom. A rear wall is joined to the side walls at a trailing edge, and also joins the top and bottom. The bottle walls define an exterior shape for guiding air.

In another aspect, the present invention provides a liquid cooled vertical shaft internal combustion engine having a cooling circuit for cooling the engine. The cooling circuit has a fluid flowing therethrough. The engine includes a cylinder block having a vertical shaft and passageways, the passageways being part of the cooling circuit. A centrifugal fan is mounted adjacent the engine block, and is driven by the vertical shaft for rotation about a vertical central axis. The fan draws air from a substantially axial direction and expels it in a substantially radial direction. A radiator mounted adjacent the cylinder block at least partially encircles the centrifugal fan in a path of the expelled air. The radiator is coupled to the cooling circuit for circulating cooling fluid therethrough. A coolant overflow bottle is interposed between the centrifugal fan and the radiator for guiding air expelled by the fan toward the radiator.

A general objective of the present invention is to reduce the number of components required for an internal combustion engine. This objective is accomplished by providing a cooling bottle which also serves as an airflow guide.

Another objective of the present invention is to provide a compact internal combustion engine. This objective is accomplished by locating the cooling bottle in a space between the fan and radiator.

The foregoing and other objects and advantages of the invention will appear from the following description. In the description, reference is made to the accompanying drawings which form a part hereof, and in which there is shown by way of illustration a preferred embodiment of the invention.

BRIEF DESCRIPTION OF THE DRAWINGS

FIG. 4 is a perspective view of the coolant bottle of FIG. 1; and

FIG. 5 is a top view of the bottle of FIG. 1.

DETAILED DESCRIPTION OF THE PREFERRED EMBODIMENTS

Figure 1:
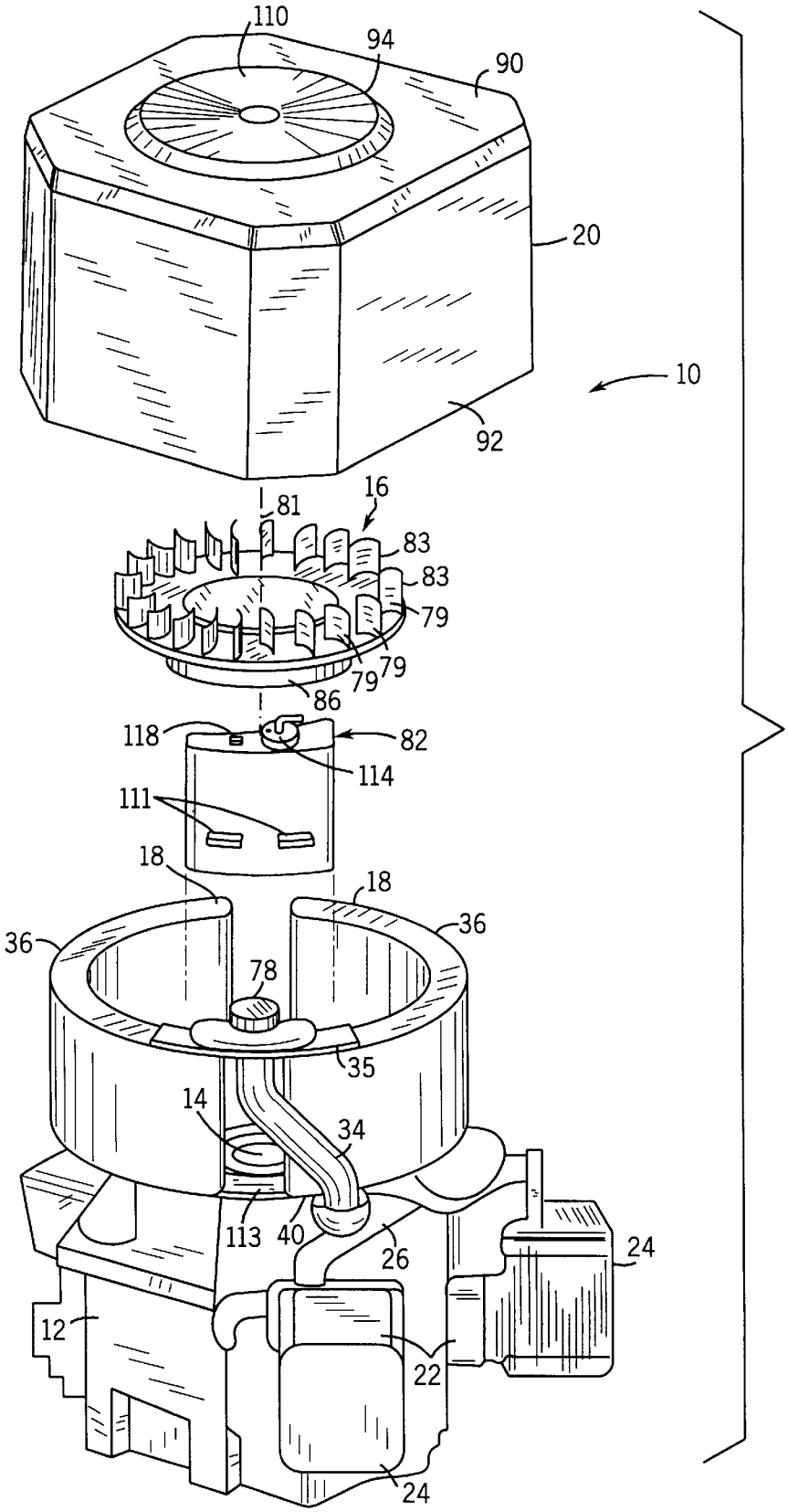
FIG. 1 is an exploded perspective view of an engine incorporating the preferred embodiment of the present invention.
Figure 2:
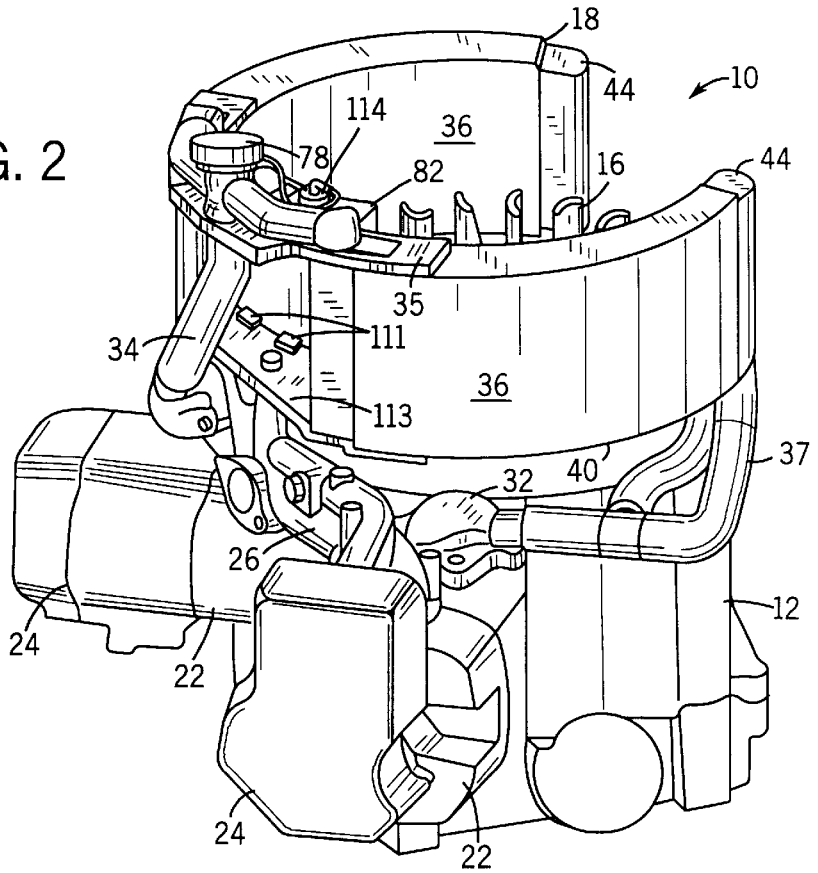
FIG. 2 is a perspective view of the engine of FIG. 1 with the air duct removed.

Referring to FIGS. 1 and 2, the major elements of a vertical shaft internal combustion engine 10 include a cylinder block 12 with a rotatably mounted vertical shaft 14, a centrifugal fan 16 mounted on the shaft 14 and above the cylinder block 12, a radiator 18 encircling the fan 16, and an air duct 20 enclosing the fan 16 and radiator 18. The internal combustion engine 10 is liquid cooled by forcing a coolant, such as water, through a cooling circuit which includes the cylinder block 12 and the radiator 18.

The cylinder block 12 has two cylinders 22 each having a head 24 disposed at one end. The cylinders 22 receive reciprocating pistons (not shown) which drive the vertical drive shaft 14. Operation of the internal combustion engine 10 generates heat in the cylinders 22 which heats the entire cylinder block 12. In order to cool the cylinders 22, coolant flows in passageways (not shown) surrounding each cylinder 22, and in each cylinder head 24. Although a two cylinder engine is described herein, the engine may have any number of cylinders without departing from the scope of the present invention.

Figure 3:
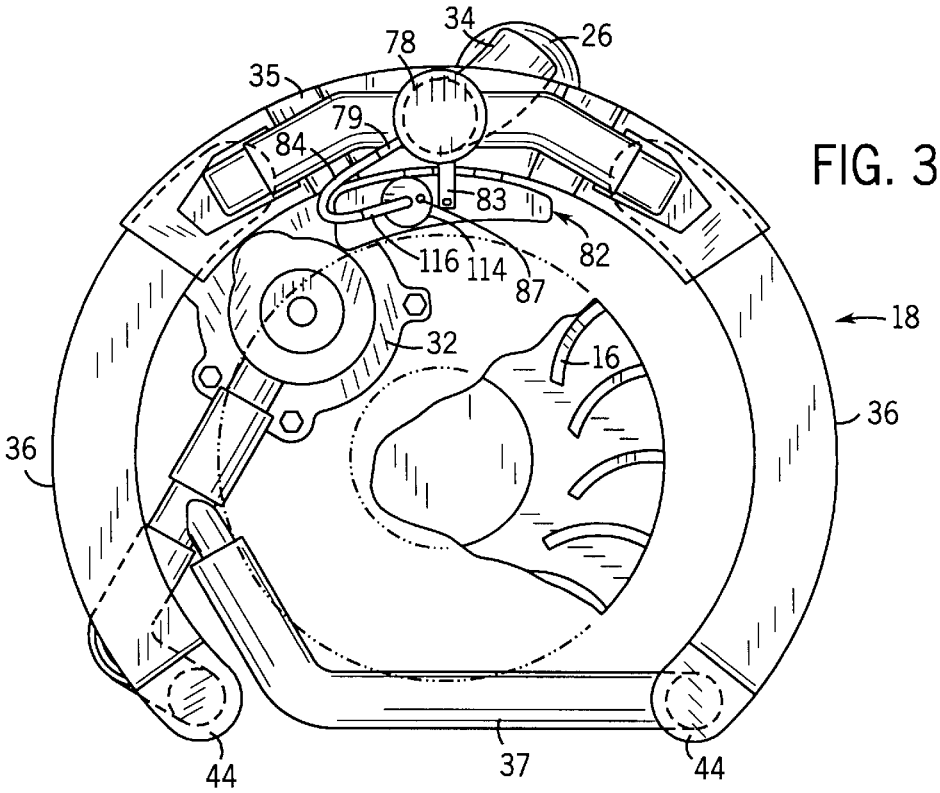
FIG. 3 is cut away top view of the engine of FIG. 2.

Referring to FIGS. 2 and 3, the passageways in the engine 10 form part of the cooling circuit which includes a manifold 26, thermostat (not shown), radiator 18 and a coolant pump 32. The cooling circuit defines a path for the coolant as it is subjected to a continuous heating and cooling cycle for cooling the engine 10.

The coolant in the passageways is heated by the engine 10 and flows from the passageways into the manifold 26. The manifold 26 receives the coolant from the passageways in all of the cylinders 22 and cylinder heads 24, and channels it past the thermostat valve. The heated coolant from all the passageways is combined in the manifold 26 reducing any pressure fluctuations in the cooling circuit generated from any particular passageway.

The thermostat valve disposed in the manifold 26 increases or decreases the flow of coolant through the circuit in response to the engine temperature. If the engine temperature falls below a certain threshold temperature, the flow of coolant through the circuit is decreased. If the engine temperature rises above a threshold temperature the flow of coolant through the circuit is increased. By controlling the flow of coolant through the circuit, the thermostat valve maintains the operating temperature of the engine 10 within a desired operating temperature range.

As shown in FIGS. 1–3, the radiator 18 is formed from two annular segments 36 and receives the heated coolant through a radiator hose 34 extending from the manifold 26.

A radiator bracket 35 joins the two annular segments, and supports the radiator hose. The annular segments 36 are mounted to the cylinder block 12 and substantially encircle the centrifugal fan 16. The annular segments 36 are connected to the cooling circuit in parallel to quickly cool the flowing coolant. Providing annular segments 36 is preferred because the segments 36 are easier to manufacture than a single annulus. Alternative shapes, such as a polygon, dome, cone, or segments thereof, may be used to encircle the fan without departing from the scope of the present invention.

Air is forced through the radiator 18 to cool the coolant in the cooling circuit by the centrifugal fan 16 mounted on the engine vertical shaft 14 and above the cylinder block 12. The centrifugal fan 16 is disposed within the area surrounded by the radiator, and has a plurality of cupped fan blades 79 equidistantly spaced about a central fan axis 81. Outer edges 83 of the fan blades 79 define a fan diameter. Although equidistantly spaced fan blades are described, staggered fan blades may also be used without departing from the scope of the present invention.

Preferably, the fan blades 79 are formed as part of a flywheel 86 which is mounted to the vertical shaft 14. Rotation of the vertical shaft 14 rotates the blades 79 about the fan central axis 81 drawing cooling air from the atmosphere in a generally axial direction toward the fan center. Air drawn into the fan center is propelled by the blades 79 in a generally radial direction toward the surrounding radiator 18. Although in a preferred embodiment, the fan 16 is formed as part of the flywheel 86, the fan 16 may be independently mounted to the shaft 14 or mounted to a different shaft driven by a drive mechanism, such as a gear box or belt drive, mounted to a vertical or horizontal shaft engine without departing from the scope of the present invention.

Referring to FIG. 3, once the coolant is cooled by passing through the radiator 18, it exits the radiator outlet chamber 44 into radiator hoses 37. The radiator hoses 37 direct the cooled coolant to the coolant pump 32 which forces the coolant back into the passageways and through the cooling circuit to cool the engine 10

Pressure caused by the coolant pump 32 and heated coolant inside the cooling circuit is controlled by a valve cap 78. The valve cap 78 is disposed above the radiator 18 and covers a fill opening in the cooling circuit. As the coolant absorbs heat generated in the engine 10, it expands increasing the pressure in the cooling circuit. The valve cap 78 has an overflow port 79 communicatively connected to a coolant overflow bottle 82 by a vent tube 84. The bottle 82 receives excess coolant and gas in the cooling circuit which is vented through the valve cap 78. Preferably, the bottle 82 includes a vent 87 to allow the gas to escape to the surrounding atmosphere.

The cooling circuit operates most efficiently when it is filled with coolant. Advantageously, the vent tube 84 between the coolant bottle 82 and the radiator hose 34 allows coolant in the coolant bottle to 82 replenish the circuit when the circuit pressure drops. When the engine 10 stops operating, the coolant temperature drops creating a vacuum in the cooling circuit. The valve cap 78 allows coolant from the coolant bottle 82 to flow back into the cooling circuit through the vent tube 84 replenishing the circuit for the coolant displaced due to expansion.

The coolant bottle 82 is interposed between the radiator 18 and the fan 16, and is shaped to guide air expelled by the fan 16 toward the radiator 18. A bottle bracket 83 extending from the radiator bracket 35 holds the bottle 82 in place. Preferably, the bottle 82 is a blow molded plastic injection bottle molded to have an exterior shape of an airflow baffle or fan volute. Advantageously, by locating the bottle 82 within the area surrounded by the radiator 18, the engine 10 is more compact.

In one embodiment, shown in FIGS. 4 and 5, the bottle 82 has a top 100 and bottom 102 which are joined by a pair of nested curved side walls 104, 106, a rear wall 108, and a front wall 110 narrower in width than the rear wall 108 to form an airfoil shape, such as an arcuate wedge. In particular, the side walls 104, 106 are joined at one edge to the front wall 110 define a leading edge at a bottle front, and opposing side wall edges are joined to the rear wall 108 to define a trailing edge. Of course, the front wall 110 could be eliminated, and the leading edge can be formed by joining the side wall edges together. Lips 111 extending outward from one curved side wall 106 rest on a lower radiator bracket 113 to support the bottle 82 when in place.

The bottle top 100 has an opening 112 which is covered by a conventional overflow cap 114 with a vent port 116 in fluid communication with the vent tube 84. The bottle 82 conventionally receives overflow coolant from the coolant system through the vent port 116. The top 100 also includes an integral upwardly extending tab 118 which engages the bottle bracket 83 to hold the bottle 82 in place.

Alternatively, the bottle can be strategically mounted to the engine, or in the engine compartment, to take advantage of the shape of the bottle to guide the air flow through the fan or radiator to increase cooling efficiency. Advantageously, the multifunction bottle can replace a conventional air baffle or fan volute to reduce the number of required engine parts.

The air duct 20 encloses, and is mounted to the radiator 18 to guide air through the radiator 18. Preferably, the duct 20 is formed from conventional materials, such as plastic or metal. Although the air duct 20 as described herein is mounted to the radiator 18, the air duct 20 may be mounted to any suitable component or bracket of the engine 10, such as to the cylinder block 12 or bracket affixed thereto, without departing from the scope of the present invention.

Looking particularly at FIG. 1, the air duct 20 is shaped having a top plate 90 and downwardly depending sides 92 to enclose the fan 16 and radiator 18 and control the flow of cooling air into and out of the radiator 18. The fan 16 draws cooling air into the duct 20 through a circular aperture 94 formed in the top plate 90. Preferably, the circular aperture 94 has a diameter smaller than the fan diameter and is substantially concentric with the fan axis 81. By providing an aperture diameter smaller than the fan diameter, air is channeled into the fan center which increases the fan efficiency and minimizes any excess air from escaping in the axial direction, thus maximizing the cooling air which passes the radiator 18.

The duct downwardly depending sides 92 enclose a portion of the radiator 18 to deflect the air which has passed through the radiator 18 downward. Advantageously, by deflecting the air downward, the heated cooling air which has passed through the radiator airways is directed toward the engine 10 to further cool the cylinder block 12.

While there has been shown and described what are at present considered the preferred embodiment of the invention, it will be obvious to those skilled in the art that various changes and modifications can be made therein without departing from the scope of the invention.

What is claimed is:

1. A coolant overflow bottle having an interior volume for receiving coolant for use with a liquid cooled internal combustion engine comprising:

a top;

a bottom;

a pair of nested curved side walls joined at a leading edge, and joining said top and bottom; and a rear wall joined to said side walls at a trailing edge, and joining said top and bottom, wherein said walls define an exterior shape for guiding air, and at least one side wall is formed to guide air in a desired direction.

2. The bottle of claim 1 in which said leading edge is defined by a front wall joined to said side walls.

3. The bottle of claim 1 in which said leading edge is defined by a junction formed by joining edges of said side walls.

4. The bottle of claim 1 in which said walls are formed from a plastic.

5. The bottle of claim 1 including an opening formed in said top.

6. The bottle of claim 5, including a cap covering said opening, and having a vent hole for escaping gas.

7. The bottle of claim 1 in which said bottle is in fluid communication with a cooling circuit of an internal combustion engine.

8. A liquid cooled vertical shaft internal combustion engine having a cooling circuit for cooling said engine, said cooling circuit having a fluid flowing therethrough, said engine comprising:

a cylinder block having a vertical shaft and passageways, said passageways being part of a cooling circuit;

a centrifugal fan mounted adjacent the engine block and being driven by said vertical shaft for rotation about a vertical central axis, wherein said fan draws air from a substantially axial direction and expels said air in a substantially radial direction;

a radiator mounted adjacent the cylinder block at least partially encircling said centrifugal fan in a path of said expelled air, said radiator being coupled to said cooling circuit for circulating cooling fluid therethrough;

a coolant overflow bottle interposed between said centrifugal fan and said radiator.

9. The engine of claim 8, in which said bottle is shaped for guiding air expelled by said fan toward said radiator.

10. The engine of claim 8, in which said bottle includes a top;

a bottom;

a pair of nested curved side walls joined at a leading edge, and joining said top and bottom; and a rear wall joined to said side walls at a trailing edge, and joining said top and bottom, wherein said walls define an exterior shape for guiding air.

11. The bottle of claim 10, in which said leading edge is defined by a front wall joined to said side walls.

12. The bottle of claim 10, in which said leading edge is defined by a junction formed by joining edges of said side walls.

13. The engine of claim 10, in which said bottle walls are formed from a plastic.

14. The engine of claim 10, in which at least one bottle side wall is formed to guide air expelled by said fan toward said radiator.

15. The engine of claim 10, including an opening formed in said bottle top.

16. The engine of claim 8, including a cap covering said opening, and having a vent hole for escaping gas.

17. The engine of claim 8, in which said bottle is in fluid communication with the cooling circuit.

18. An internal combustion engine having a cooling circuit for cooling said engine, said cooling circuit having a fluid flowing therethrough, said engine comprising:

a cylinder block having passageways, said passageways being part of a cooling circuit;

a radiator mounted adjacent the cylinder block and being coupled to the cooling circuit for circulating cooling fluid therethrough;

a fan mounted adjacent the engine block for blowing air past said radiator for cooling circulating cooling fluid; and a coolant overflow bottle interposed between said fan and said radiator, and having a surface for guiding air expelled from said fan toward said radiator.

* * * * *